US007213848B2

(12) United States Patent
Hagan

(10) Patent No.: US 7,213,848 B2
(45) Date of Patent: May 8, 2007

(54) SPRING OPEN LATCH CLAMP

(75) Inventor: Kenneth Hagan, East Pointe, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 98 days.

(21) Appl. No.: 10/682,543

(22) Filed: Oct. 9, 2003

(65) Prior Publication Data

US 2005/0077736 A1 Apr. 14, 2005

(51) Int. Cl.
*E05C 5/00* (2006.01)

(52) U.S. Cl. ..... 292/247; 24/494

(58) Field of Classification Search ..... 292/113, 292/247; 24/68 R, 68 T, 494
See application file for complete search history.

(56) References Cited

U.S. PATENT DOCUMENTS 1,002,901 A * 9/1911 Christman ..... 24/71 TD
3,346,929 A * 10/1967 Webb ..... 24/494
4,493,133 A * 1/1985 Nilsson ..... 24/68 T
4,743,052 A * 5/1988 Stammreich et al. ..... 292/113
5,165,148 A * 11/1992 Fleischer et al. ..... 24/494
5,620,212 A * 4/1997 Bourne et al. ..... 292/113
5,667,261 A * 9/1997 Weinerman et al. ..... 292/247
6,279,971 B1 * 8/2001 Dessenberger, Jr. ..... 292/113
6,343,815 B1 * 2/2002 Poe ..... 292/113
6,374,465 B1 * 4/2002 Dykstra ..... 24/68 T
6,561,556 B2 * 5/2003 Fuchs ..... 292/256.69

* cited by examiner

*Primary Examiner*—Gary Estremsky
(74) *Attorney, Agent, or Firm*—Raggio & Dinnin, P.C.

(57) ABSTRACT

A manual pull action clamp is disclosed. The manual pull action clamp includes a base and a handle including a first and second portion. The handle is pivotally connected to the base. The clamp further includes a pin arranged between the first and second portions of the handle. The clamp also has a bracket secured to the pin. The clamp also includes a spring arranged between the handle and the pin. The clamp is such that it is capable of one-handed operation and of holding various forces depending on the design of the clamp and the clamping environment.

18 Claims, 2 Drawing Sheets

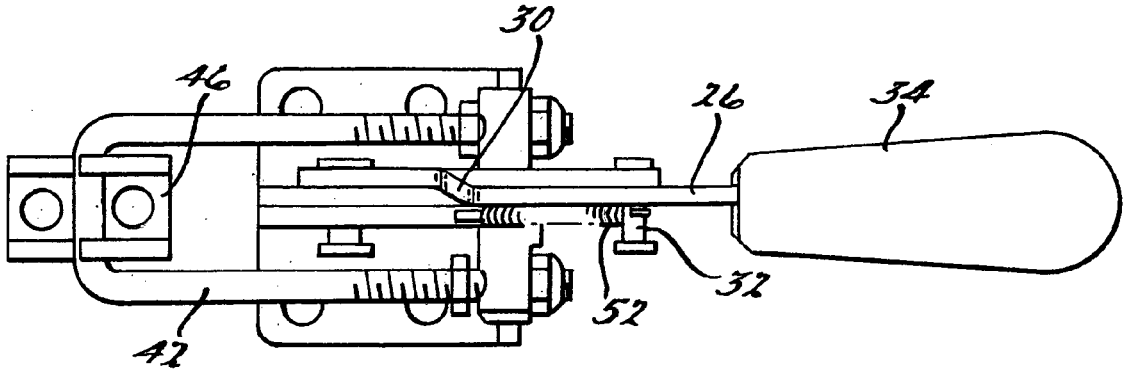
FIG. 3.
FIG. 4.
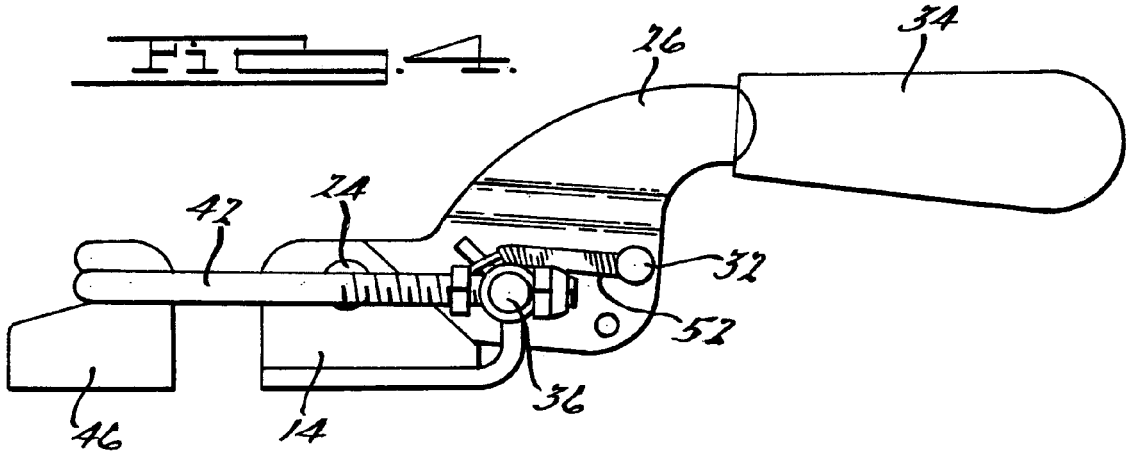
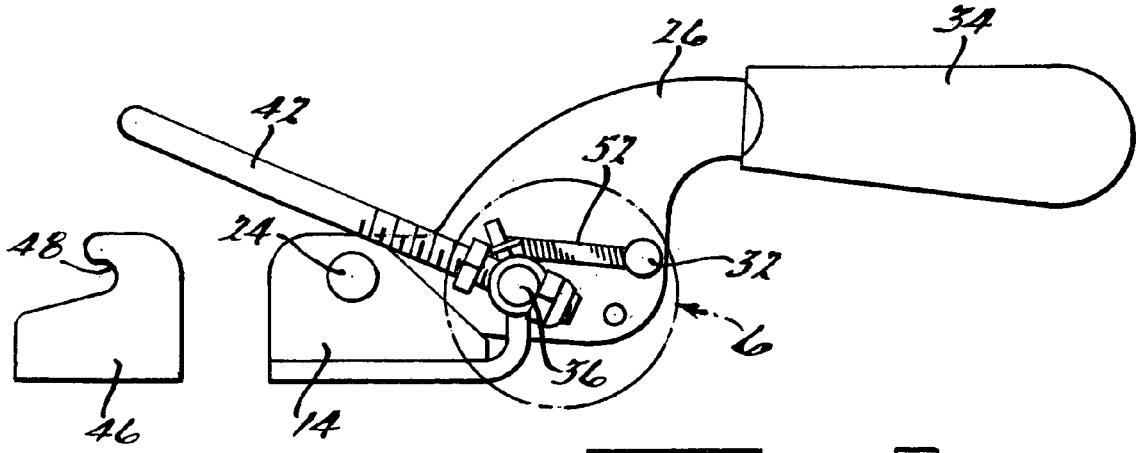
FIG. 5.

SPRING OPEN LATCH CLAMP

BACKGROUND OF THE INVENTION

1. Field of the Invention

The present invention generally relates to manual clamps, and more particularly, relates to a manual toggle locking pull action clamp.

2. Description of Related Art

Manual clamps including pull action clamps and toggle locking action clamps have been known for numerous years. Prior art toggle clamps may include an extension of folded sheet metal riveted to both sides of a central handle housing, which has a pivoted latch element and leaf spring reacting against surfaces of the handle to preposition the latch for engaging a base mounted latch pin upon actuating the clamp handle to a clamping position. These prior art clamps are also simple to release by manual finger activation of a lever. Other prior art toggle clamps may use a locking means that include a flat leaf spring lock welded to the handle that is released by a trigger member.

Many of these prior art over center toggle locking action clamps are ideally suited for holding against heavy forces such as those generated in plastic molding operations or the like. These clamps are ideal for quick clamping of doors, lids, access covers on drums, containers or other vessels. Generally, these clamps work with a latch or bracket mechanism that engages a latch plate located on a door or the like. When the prior art clamps are in the open position, the latch or bracket is placed over the latch plate and then the handle is pushed in a downward motion until the clamp toggles onto an over center position. This will lock the clamp in position and lock the door or access cover to the body being clamped. Generally, the prior art clamps require two hands to operate these manual clamps. There have been some prior art clamps that have attempted to create one hand action for opening and closing of the clamps.

Many of these manual prior art clamps operate satisfactorily but are frequently subjected to environments of vibration, inverted positioning, and other harsh industrial environments. Therefore, many of the prior art clamps require both of the user's hands to open the clamp, i.e., one hand is needed to operate the clamp lever while the other is needed for pulling back the latch element on the clamp. Hence, there is a need in the art for an improved manual pull action clamp that is capable of one-handed operation in the work environment while also providing for an automatic retraction of a latch or bracket mechanism from the latch plate without use of the operator or user's second hand. There also is a need in the prior art for an improved manual pull action clamp.

SUMMARY OF THE INVENTION

One object of the present invention is to provide an improved clamp.

Another object of the present invention is to provide an improved one handed operation clamp.

Yet a further object of the present invention is to provide a clamp that uses a combination of a thumb tab lever and a spring to provide a novel positioning device for a bracket of the clamp.

Still a further object of the present invention is to provide a manual hand clamp that will hold a connecting bracket arm in a predetermined out of way position.

Still a further object of the present invention is to provide a more robust and economical clamp.

To achieve the foregoing objects, a manual clamp is disclosed. The clamp includes a base with a handle including a first and second portion. The handle is pivotally connected to the base. A pin is arranged between the first and second portions of the handle. A bracket or arm is secured to the pin. The clamp further includes a spring arranged between the handle and the pin.

One advantage of the present invention is that the clamp provides a new solution for one handed clamp operation.

A further advantage of the present invention is that the clamp uses a thumb tab in conjunction with a spring.

Still another advantage of the present invention is that the clamp will use a spring to hold a connecting arm or bracket in a predetermined out of way position.

Still a further advantage of the present invention is the reduced time to operate the hand clamp in operating environments.

Yet another advantage of the present invention is the one handed operation of closing and opening of the clamp according to the present invention.

Other objects, features and advantages of the present invention will become apparent from the subsequent description and the appended claims, taken in conjunction with the accompanying drawings.

BRIEF DESCRIPTION OF THE DRAWINGS

FIG. 4 shows a side view of a clamp according to the present invention with one portion of the handle removed.

FIG. 5 shows a side view of the clamp according to the present invention, with one portion of the handle removed, having the clamp in its opened position and the latch arm stored in its predetermined open position.

FIG. 6 shows a close up view of the spring mechanism of the clamp according to the present invention.

DESCRIPTION OF THE EMBODIMENT(S)

Figure 1:
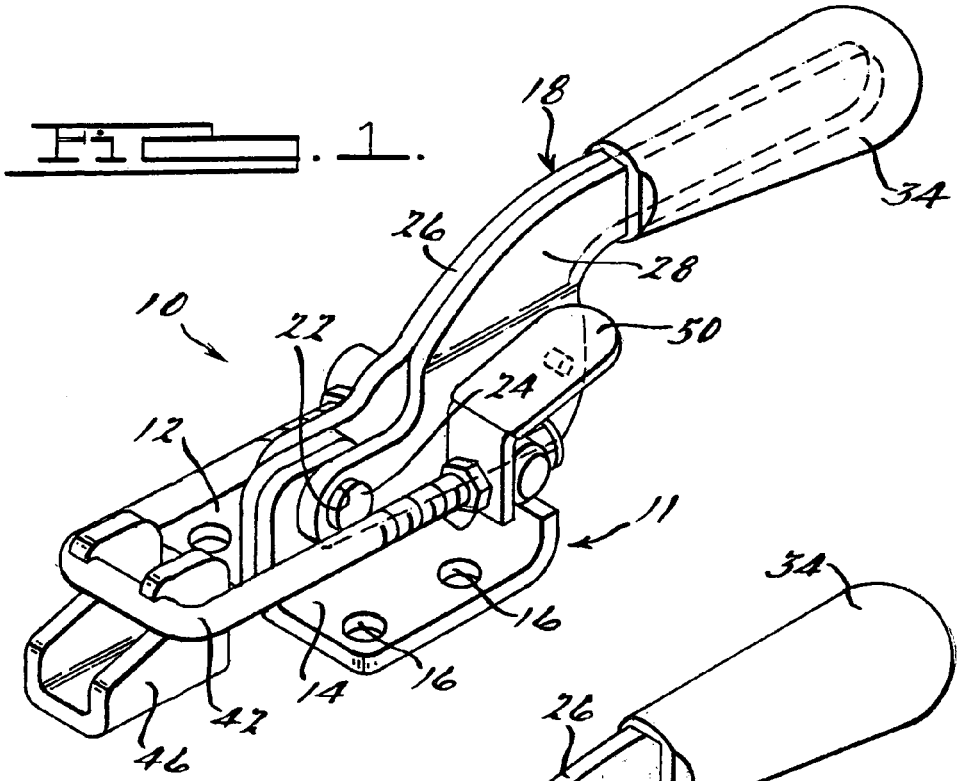
FIG. 1 shows a plan view for a clamp according to the present invention.
Figure 2:
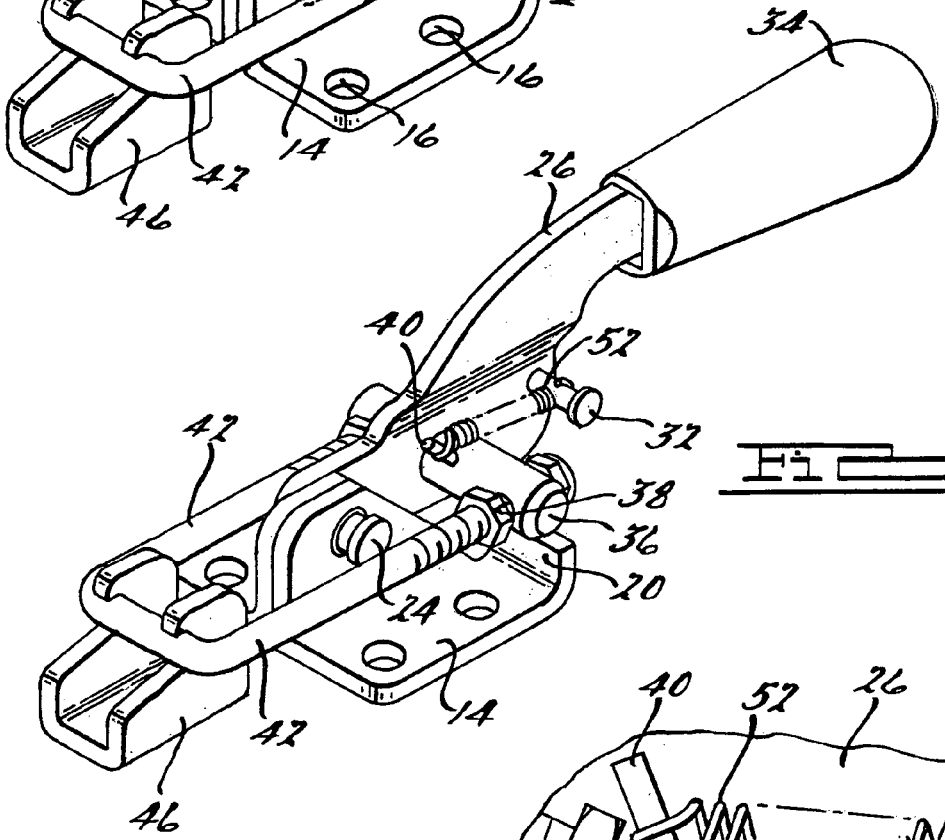
FIG. 2 shows a partial plan view of a clamp according to the present invention.
Figure 3:
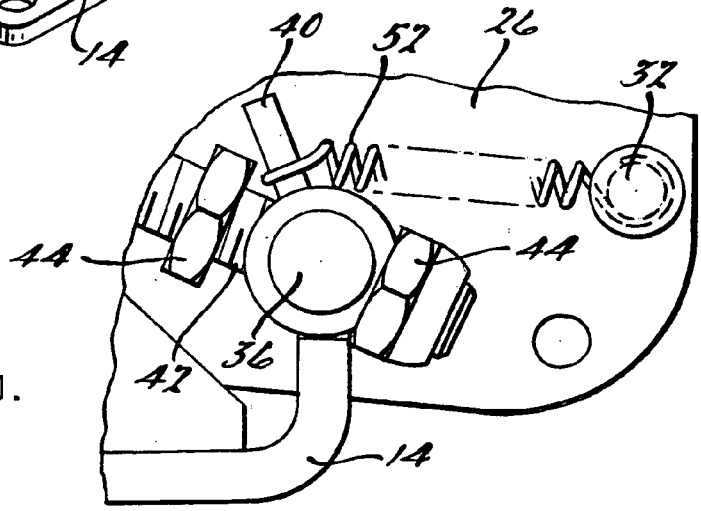
FIG. 3 shows a top view of a clamp according to the present invention with one portion of the handle removed.

Referring to the drawings, a clamp 10 according to the present invention is shown. It should be noted that the clamp 10 as shown in the drawings, is a manual pull action toggle locking clamp. However, any other type of manual clamp such as hold down action clamps, straight line action clamps, latch action clamps or squeeze action clamps may also be used in conjunction with the accompanying disclosed invention. It should also be noted that the present invention can be used on any known toggle action clamp or cam action clamp.

Referring to FIG. 1, a manual clamp 10 according to the present invention is shown. The clamp 10 includes a base 11. The base 11 shown in the drawings has a first 12 and second base member 14 which are similar to each other. The base members 12, 14 include a plurality of orifices 16 there through. The orifices 16 are used to connect the base 11 to a door, wall, or other device that is part of the clamping environment. Another set of the orifices are used to connect a handle 18 thereto. The base 11 is generally made of a steel material however any other type of metal, hard plastic, ceramic or composite may be used for the base 11 of the clamp 10. The base 11 may be made of a single piece of steel and not have the first 12 and second members 14 as shown in the drawings. However, it is preferred to have a first 12 and second member 14 as shown in the drawings. The first 12 and second members 14 are arranged as shown in FIG. 1, to create the base 11 of the clamp 10. The base members 12, 14 generally have an L-shape. The base 11 may also include an upturned flanged or edge 20 on one portion thereof. The base members 12, 14 generally are arranged back to back to one another. However, it should be noted that the base members 12, 14 may be welded together or have any other type of chemical or mechanical bond used to hold the base members 12, 14 together.

The handle 18 is pivotally connected to the base 11 via an orifice 16 in the base 11 and an orifice 22 in the handle 18. A fastener 24 is used to connect the handle 18 to the base 11. The handle 18 is connected to the base 11 such that it pivots or rotates about the fastener 24 such that the handle 18 rotates with respect to the base member 11. In one embodiment a rivet 24 is used, however a pivot pin, dowel, rod or the like may also be used as a fastener or pivot connection 24.

The handle 18 is generally made of a steel material however any other metal, plastic, hard ceramic, or composite may be used for the handle 18. The handle 18 includes a first 26 and second member or portion 28. The first and second member 26, 28 of the handle 18 each individually include an outward extending rigid portion 30. When the two members 26, 28 of the handle 18 are used in the clamp 10, as shown in FIG. 1, they are placed in a side by side manner such that the outward extending rigid 30 of each handle member 26, 28 will in part define an interior space between the first and second members 26, 28 of the handle 18. The first and second members 26, 28 of the handle 18 are arranged around the first and second members 12, 14 of the base 11 such that the inner surface of the first and second members 26, 28 of the handle 18 contact the outer surfaces of the base members 12, 14 at or near the pivot point connection 24. The handle 18 includes a plurality of orifices therethrough. One set of orifices is aligned and used to connect with the base 11 while the other set of orifices have a fastener or pin 32 arranged therebetween to help in holding the handle members 26, 28 securely to one another in the clamp environment. It should be noted that in one embodiment a rivet is used as the fastener 32 but any other type of rod, dowel, pin or any other known fastener may be used between the two handle members 26, 28.

In one embodiment a soft plastic handle grip 34 is arranged on one end of the handle 18. The handle grip 34 can be made of any number of soft materials such as rubber, plastic, composites, cloth, etc.

A pivot pin 36 is rotatably supported through an orifice of the handle 18. It should be noted that in the preferred embodiment a pivot type pin 36 is used but any other cylindrical shape member, rod, dowel, or the like may be used for the pin 36. The pin 36 is rotatable relative to the handle 18 and will allow for a pivot movement of the pin 36 within the orifice of the handle 18. The pin 36 includes at least one orifice 38 through a diameter thereof and in the embodiment shown there is a second orifice 38, with one orifice 38 located near each end of the pin 36. In one embodiment the pin 36 is made of a steel material, however any other type of metal material, hard plastic, ceramic, or composite may be used for the pin material. The pin 36 has a projection 40 extending from a surface thereof. The projection 40 generally has the form of a small dowel, rod, pin, cylindrical member or the like. However, it should be noted that any other shape member may be used for the projection 40 extending from the surface of the pivot pin 36. The projection 40 is arranged on the surface of the pivot pin 36 such that it is located between the first 26 and second member 28 of the handle 18. The pivot pin 36 is capable of 360° rotation within the handle 18 of the clamp 10.

A latch or bracket 42 is secured to the pivot pin 36 through the orifices 38 in the pivot pin 36. The latch or bracket 42 may have any known shape or configuration that is capable of use in the clamping environment. In the embodiment shown, a U-shaped latch bracket 42 is used. The latch bracket/arm 42 in the embodiment shown is a U-bolt that has threads on the ends thereof. The latch bracket 42 is connected to the pivot pin 36 via any known fasteners 44 or any other type of mechanical or chemical connecting means. The U-shaped bracket 42 will pivot with respect to the handle 18 of the clamp 10. In the embodiment shown the latch bracket 42 is made of a steel material, however any other type of metal, hard ceramic, plastic, composite or other durable strength material may be used. It should be noted that a latch arm 42 may be connected to just one end of the pivot pin 36 and include a hook or other type of end and not have the U-shape as shown in the Figures.

A latch plate 46 is located on a door or work piece to be held by the clamp 10 in the work environment. The latch plate 46 generally has a U-shaped cross section. The latch plate 46 also includes a notch 48 near a top end thereof which will interengage and contact the end of the latch bracket 42 from the clamp 10. The latch bracket 42 will be placed over the latch plate 46 such that the latch bracket 42 contacts the notch 48 of the latch plate 46 and when the clamp 10 is put in a fully closed or over center position the latch bracket 42 will become firmly engaged to the latch plate 46 thus securing the door or work piece being held in the clamping environment. The latch plate 46 is connected to the door or work piece via any known fastener.

A thumb tab or lever 50 is arranged around at least one end of the latch bracket 42. The thumb tab 50 generally has an L-shape. The thumb tab 50 includes an orifice which will be placed around one end of the latch bracket 42. The thumb tab 50 will be secured between a fastener 44 and the pivot pin 36 on one side of the latch bracket 42. It should be noted that a thumb tab or lever 50 may also be placed on the opposite side of the U-shaped latch bracket 42 such that a thumb tab 50 is located on each side of the clamp 10 for easy use for a left or right handed user. It should also be noted that if a single thumb tab 50 is used it may be placed on either side of the latch bracket 42 depending on if the user is a right or left handed person. The thumb tab 50 will assist in making the clamp 10 a one-handed clamp by allowing the user to use one hand to place the latch bracket 42 over the latch plate 46 before securing the clamp 10 in its closed or over locked position.

The clamp 10 also includes a spring 52 arranged between the fastener 32, located between the two members 26, 28 of the handle 18, and the projection 40 extending from the surface of the pivot pin 36. In the embodiment shown a regular extension spring 52 is preferably used to secure the fastener 32 on one end and the cylindrical projection 40 on the opposite end of the spring 52. It should be noted that any other type of spring 52 may be used including regular extension springs, torsion springs or any other type of spring known in the art. The spring 52 will be arranged between the first 26 and second member 28 in the space defined by the two handle members 26, 28 and the pivot pin 36. The location of the spring 52 in the space between the two handle members 26, 28 will help protect the spring 52 from any damage due to environmental contaminates found in the clamp environment. This will also ensure that the spring 52 is not accidentally removed or damaged by the user's hands and thus is not capable of being mistakeningly disengaged during operation of the clamp 10 by the user. The spring 52 will allow the latch bracket or connecting arm 42 to be held in a predetermined out of way position when the clamp 10 is in an open position. Thus, when the clamp 10 is opened the latch bracket 42 will be moved, via the spring 52, to a predetermined holding position until the clamp 10 is reengaged with the latch plate 46 and secured into its closed position. The combination of the thumb tab 50 with the spring 52 will ensure that the clamp 10 is completely one-hand operable. The thumb tab 52 will ensure that when the clamp 10 is being put into its closed position that the operator can use the thumb tab 50 to arrange the latch bracket 42 around the latch plate 46 on the work piece being held or the door being latched. Then the clamp 10 will be closed in its usual downward motion until the handle 48 creates an over center toggle locking effect for the clamp 10. Upon opening of the clamp 10 the spring 52 will automatically reposition the latch bracket 42 into an out of way position thus not hindering the user in any manner during operation of the clamp 10. This will increase efficiency and speed by the user on the work line environment. It should be noted that in the embodiment shown a metal spring is used however any other type of spring such as ceramic, plastic, composite or the like may be used depending on the design requirements and the operating environment of the clamp.

FIGS. 1, 2, 3 and 4 show the clamp in its closed or locked position. FIG. 5 shows the clamp 10 in an open position with the latch bracket 42 in its predetermined stored position. In prior art clamps when the clamp was in an open position or not secured to the latch plate, the latch bracket would either fall and lean on the handle or be resting on the top of the latch plate when the clamp was in an open position. With the present invention, the latch bracket 42 is held in the predetermined position as shown in FIG. 5 by the spring 52 arranged between the fastener 32 and the projection 40 extending from the pivot pin 36. In operation the user would take the clamp 10 from its open position, and move the handle in an upward rotating position towards the latch plate 46 until the latch bracket 42 is over the latch plate 46 and then the thumb lever 50 would be pressed in a forward direction until the latch bracket 42 engages the notch 48 of the latch plate 46. Then the clamp handle 18 would be moved in the opposite direction away from the latch plate 46 until the pivot pin 36 and pivot point 24 between the handle 18 and base 11, along with the latch bracket 42, form an over center toggle locking position. When the clamp 10 is put in the over center toggle locking position the toggle action will create the greatest holding force for the clamp 10. After the manufacturing or other operation is completed on the work piece or door being held, the user will pull the clamp handle 18 in a rotational direction towards the latch plate 46 until the over center toggle action is overcome and the latch bracket 42 disengages from the latch plate 46. Then the spring 52 will automatically move the latch bracket 42 to the predetermined holding position when the clamp 10 is in its open position.

The present invention has been described in an illustrative manner. It is to be understood that the terminology which has been used is intended to be in the nature of words or description rather than of limitation.

Many modifications and variations of the present invention are possible in light of the above teachings. Therefore, within the scope of the appended claims, the present invention may be practiced otherwise than as specifically described.

What is claimed is:

1. A clamp, said clamp including:
- a base;
- a handle connected to said base;
- a pin rotatably supported within said handle;
- a bracket secured to said pin, said bracket rotates with respect to said handle;
- a lever having an orifice through a surface, one end of said bracket arranged through said orifice; and
- a spring arranged between said handle and said pin, said spring automatically repositions and holds said bracket a predetermined distance from a surface of said handle when the clamp is open.

2. The clamp of claim 1 wherein said lever contacting said pin and said bracket.

3. The clamp of claim 2 wherein said lever is arranged on one or both sides of said handle.

4. The clamp of claim 1 wherein said handle having a first and second member.

5. The clamp of claim 4 wherein said pin having a projection extending therefrom.

6. The clamp of claim 5 further including a fastener arranged between said first and second member of said handle.

7. The clamp of claim 6 wherein said spring contacts said fastener on one end and said projection on an opposite end.

8. The clamp of claim 7 wherein said spring is arranged in a space defined in part by said first and second member.

9. The clamp of claim 1 wherein said base having a first and second member.

10. A manual pull action clamp, said clamp including:
- a base;
- a handle including a first and second portion, said handle pivotally connected to said base;
- a pin arranged therebetween said first and second portions of said handle, said pin having a cylindrical projection extending from a surface thereof;
- a bracket secured to said pin;
- a lever having a generally L-shape and an orifice through a surface thereof; and
- a spring arranged between said handle and said pin, said spring automatically repositions and holds said bracket a predetermined distance from a surface of said handle when the clamp is open.

11. The clamp of claim 10 wherein said lever arranged near one end of said bracket.

12. The clamp of claim 10 further including a latch plate contacting said bracket when the clamp is in a closed position.

13. The clamp of claim 10 wherein said base having a first and second member.

14. A manual pull action clamp, said clamp including:
- a base;
- a handle including a first and second portion, said handle pivotally connected to said base;
- a pin arranged therebetween said first and second portions of said handle;
- a bracket secured to said pin, said bracket having a U-shape and secured to said pin on both ends thereof;
- a lever having a generally L-shape and an orifice through a surface thereof; and
- a spring arranged between said handle and said pin, said spring automatically repositions and holds said bracket a predetermined distance from a surface of said handle when the clamp is open.

15. The clamp of claim 14 wherein said first and second portion having a fastener arranged therebetween.

16. The clamp of claim 15 wherein said spring is arranged between said first and second portion.

17. The clamp of claim 16 wherein said spring is secured to said fastener on one end and to said projection on an opposite end.

18. A manual toggle locking pull action clamp, said clamp including:

a base having a plurality of orifices therethrough;

a handle having a first and second member, said handle pivotally connected to said base, said handle having a fastener arranged between said first and second member;

a cylindrical rod pivotally arranged between said first and second members of said handle;

a latch member secured to said rod, said latch member pivots with respect to said handle;

a pin extending from a surface of said rod;

a spring secured to said pin on one end and to said fastener on an opposite ends said spring automatically repositions and holds said bracket a predetermined distance from a surface of said handle when the clamp is open;

a tab lever arranged over at least one end of said latch member; and a latch plate contacting said latch member when the clamp is in a closed position.

* * * * *

UNITED STATES PATENT AND TRADEMARK OFFICE

CERTIFICATE OF CORRECTION

PATENT NO. : 7,213,848 B2
APPLICATION NO. : 10/682543
DATED : May 8, 2007
INVENTOR(S) : Kenneth Hagan It is certified that error appears in the above-identified patent and that said Letters Patent is hereby corrected as shown below:

Col. 8, Line 5, Claim 18 - Please delete “ends”and insert --end, -- after “on an opposite”.

Signed and Sealed this

Twenty-sixth Day of June, 2007

JON W. DUDAS
*Director of the United States Patent and Trademark Office*